US008129646B2

(12) United States Patent
Lee et al.

(10) Patent No.: US 8,129,646 B2
(45) Date of Patent: Mar. 6, 2012

(54) SYSTEM AND METHOD FOR VALIDATING MAILINGS RECEIVED

(75) Inventors: Raymond Lee, Chicago, IL (US); Brian Bowers, Mundelein, IL (US); Gary Van Ermen, Palatine, IL (US); Steven Seburn, Buffalo Grove, IL (US); Paul Kostyniuk, Wilmette, IL (US)

(73) Assignee: Bell and Howell, LLC, Durham, NC (US)

( * ) Notice: Subject to any disclaimer, the term of this patent is extended or adjusted under 35 U.S.C. 154(b) by 355 days.

(21) Appl. No.: 12/467,043

(22) Filed: May 15, 2009

(65) Prior Publication Data

US 2009/0294338 A1 Dec. 3, 2009

Related U.S. Application Data

(63) Continuation-in-part of application No. 11/199,259, filed on Aug. 9, 2005, now Pat. No. 7,741,575.

(60) Provisional application No. 60/629,407, filed on Nov. 22, 2004, provisional application No. 61/053,965, filed on May 16, 2008.

(51) Int. Cl.
*B07C 5/00* (2006.01)

(52) U.S. Cl. ..... 209/584; 209/583; 209/900; 700/219; 700/224; 700/226; 705/406; 705/407; 705/409; 705/410

(58) Field of Classification Search ..... 209/583, 209/584, 900; 382/101
See application file for complete search history.

(56) References Cited

U.S. PATENT DOCUMENTS

| | | | | |
|---|---|---|---|---|
| 4,908,768 | A | | 3/1990 | Gelfer et al. |
| 5,249,687 | A | * | 10/1993 | Rosenbaum et al. ..... 209/3.3 |
| 5,419,440 | A | | 5/1995 | Picoult |
| 5,459,670 | A | | 10/1995 | Johnson et al. |
| 5,475,603 | A | | 12/1995 | Korowotny |
| 6,098,057 | A | | 8/2000 | Dlugos |
| 6,101,487 | A | | 8/2000 | Yeung |
| 6,135,292 | A | | 10/2000 | Pettner |

(Continued)

FOREIGN PATENT DOCUMENTS

EP 0 481 569 A 4/1992

OTHER PUBLICATIONS

United States Office Action issued in U.S. Appl. No. 12/078,499 dated Jan. 3, 2011.

(Continued)

*Primary Examiner* — Terrell Matthews
(74) *Attorney, Agent, or Firm* — McDermott Will & Emery LLP

(57) ABSTRACT

The present subject matter relates generally to techniques and/or equipment for validating mail items within a mail processing system. Sort scheme data and mail item identification data are loaded into the mail processing system. The mail item identification data includes a mail owner identification value and a unique mail item identifier. Then, mail item identification data is acquired from each of the mail items processed in the system and validated against the loaded mail item identification data. The method may involve storing mail item validation data. The mail items are sorted in accordance with the loaded sort scheme data. Further, the present subject matter relates generally to building reports based on the information derived from the techniques and/or equipment utilized therein.

13 Claims, 6 Drawing Sheets

U.S. PATENT DOCUMENTS

| | | | | |
|---|---|---|---|---|
| 6,303,889 | B1 | 10/2001 | Hayduchok et al. | |
| 6,311,892 | B1 * | 11/2001 | O'Callaghan et al. | 235/375 |
| 6,501,041 | B1 | 12/2002 | Burns et al. | |
| 6,575,358 | B2 * | 6/2003 | O'Callaghan et al. | 235/375 |
| 6,655,683 | B2 | 12/2003 | Engarto et al. | |
| 6,674,038 | B1 | 1/2004 | Latta | |
| 6,697,500 | B2 * | 2/2004 | Woolston et al. | 382/101 |
| 6,749,194 | B2 | 6/2004 | Hanson et al. | |
| 6,793,136 | B2 | 9/2004 | Wells et al. | |
| 6,826,548 | B2 | 11/2004 | Hungerpiller et al. | |
| 6,998,558 | B2 * | 2/2006 | Forella et al. | 209/584 |
| 7,048,191 | B2 | 5/2006 | Park et al. | |
| 7,397,010 | B2 * | 7/2008 | Wilke | 209/584 |
| 7,522,971 | B2 | 4/2009 | Brehm et al. | |
| 7,745,754 | B2 | 6/2010 | Conard et al. | |
| 2002/0053533 | A1 | 5/2002 | Brehm et al. | |
| 2003/0200113 | A1 | 10/2003 | Latta | |
| 2004/0049316 | A1 | 3/2004 | Pintsov et al. | |
| 2004/0054552 | A1 | 3/2004 | Amonette et al. | |
| 2004/0188522 | A1 | 9/2004 | Ashaari | |
| 2005/0216119 | A1 * | 9/2005 | Hamilton | 700/224 |
| 2006/0102529 | A1 | 5/2006 | Wilke | |
| 2008/0000817 | A1 | 1/2008 | Kostyniuk et al. | |
| 2008/0179225 | A1 * | 7/2008 | Bowers et al. | 209/584 |

OTHER PUBLICATIONS

European Search Report issued in European Patent Application No. EP 05025368.01-2307 dated on Jan. 27, 2009.

United States Notice of Allowance issued in U.S. Appl. No. 11/199,259 dated Apr. 15, 2010.

United States Office Action issued in U.S. Appl. No. 11/199,259, mailed Oct. 15, 2009.

European Search Report issued in European Patent Application No. EP 05025368.1 dated Jul. 6, 2009.

Partial European Search Report issued in European Patent Application No. 05 02 5368 dated Dec. 18, 2008.

United States Office Action issued in U.S. Appl. No. 12/078,499, mailed Jul. 16, 2010.

European Office Action issued in European Patent Application No. EP 05 025 368.1 dated Aug. 4, 2011.

United State Office Action issued in U.S. Appl. No. 12/078,499 dated Sep. 22, 2011.

* cited by examiner

SYSTEM AND METHOD FOR VALIDATING MAILINGS RECEIVED

RELATED APPLICATIONS

This application is a continuation-in-part of U.S. patent application Ser. No. 11/199,259 Filed Aug. 9, 2005 (Publication No. US 2006/0108266 A1), now U.S. Pat. No. 7,741,575, which claims the benefit of U.S. Provisional Application No. 60/629,407 Filed Nov. 22, 2004 the disclosures of which are entirely incorporated herein by reference.

This also application claims the benefit of U.S. Provisional Application No. 61/053,965 Filed May 16, 2008, the disclosure of which also is entirely incorporated herein by reference.

TECHNICAL FIELD

The subject matter discussed herein relates to a method and system for mail item processing, and particularly, a method and system for validating mail items received from a prior mail processing device.

BACKGROUND

Document processing facilities often use high speed document processing machines such as sorters, to sort and direct mail items appropriately to one or more mail bins for distribution. Various types or stages of processing may occur during sorting of the mail items as they are transported at high speeds along a transport path of the sorter via a system of mechanized pulleys, levers and rollers. Such processes may include, but are not limited to imaging of each mail item at various moments of transport, interpretation of address components (e.g., recipient addresses, ZIP codes, barcodes) based on the image as marked upon the mail items for enabling association of each mail item with a sort scheme, printing upon the mail item, application of labels, opening or cutting of the mail item, etc. Generally, these processes are coordinated by one or more computers operating in connection with the sorter. In a multi-sorter environment, where a mailing is distributed for processing amongst multiple sorters, a server may act as a central administrator of sorter activity—i.e., facilitating data exchange, managing job scheduling and processing, coordinating sort schemes amongst sorter devices, etc.

The common goal of any sort operation is to arrange a plurality of disparate mail items into mail groups that conform to postal authority standards. Generally, the postal grouping to which a mail item belongs is based on the delivery point identifiers indicated upon the mail item, such as the ZIP Code designation, address data, etc. Other factors regarding the mail item, such as weight class or postage application may further affect how it is classified by the postal authority and hence delivered via the postal network. Regardless of classification, however, a single postal grouping may include mail items possessing a plurality of delivery point identifiers or only one (e.g., one or more ZIP Code designations). Sort processing of disparate mail items into mail groupings associated by common postal authority recognized delivery point identifiers leads to increased postal processing and postal authority work sharing discounts.

Quite often, mail processing tasks must be distributed across multiple document processing devices, and in some instances, multiple differing mail processing environments entirely. For instance, a mailing may be created and originated by an inserting environment of a customer, but subsequently sort processed for mailing via the postal authority on behalf of that customer by a pre-sort bureau or other sort processing vendor. Alternatively, differing sort processing environments may share or co-mingle their mailings in an effort to produce maximum work sharing discount incentives for the participating parties. So, for example, a first sort processing environment may provide mail having certain delivery point identifiers upon it that increase the mail volume of a second sort processing environment, enabling said second sort processing environment to generate greater discounts, and vice versa. Regardless of the arrangement, where multiple different environments are employed to process a mailing, a receiving mail processing environment must be able to validate the mail it receives from the sending environment. Furthermore, supporting mail documentation must accurately account for each mail item shared, while providing a clear point-of-origination and accountability of mail items processed or missing.

Therefore, a need exists for a method and system for mail item processing, and particularly, a method and system for validating mail items received from a prior mail processing device or environment.

SUMMARY

The present disclosure generally describes a system, software and one or more methods for validating mail items or mail trays within a mail processing system.

For example, the detailed description provides for a method of validating mail item within a mail processing system. The method includes loading sort scheme data and mail item identification data for the mail items into a processor of the mail processing system. The mail item identification data includes at least a mail owner identification value and a unique mail item identifier for each of the mail items. Mail item identification data is acquired from each of the mail items processed in the system. The acquired mail item identification data is validated against the loaded mail item identification data for each of the mail items. Mail item validation data is stored responsive to the outcome of the validating step. Mail items are sorted in accordance with the loaded sort scheme data. Other parameters besides mail owner identification and a unique mail item identifier may be used to establish mail item identification. Likewise, mail tray identification data may also be generated for enabling effective processing of mail trays.

Those skilled in the art will recognize that the techniques outlined above will often be implemented using programmed computers and/or network communications. Hence, the methodology may be embodied in appropriate programmed computer systems or in software products for programming one or more such systems Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict concepts by way of example, not by way of limitations. In the figures, like reference numerals refer to the same or similar elements. In the figures, like reference numerals refer to the same or similar elements.

DETAILED DESCRIPTION

Figure 1:
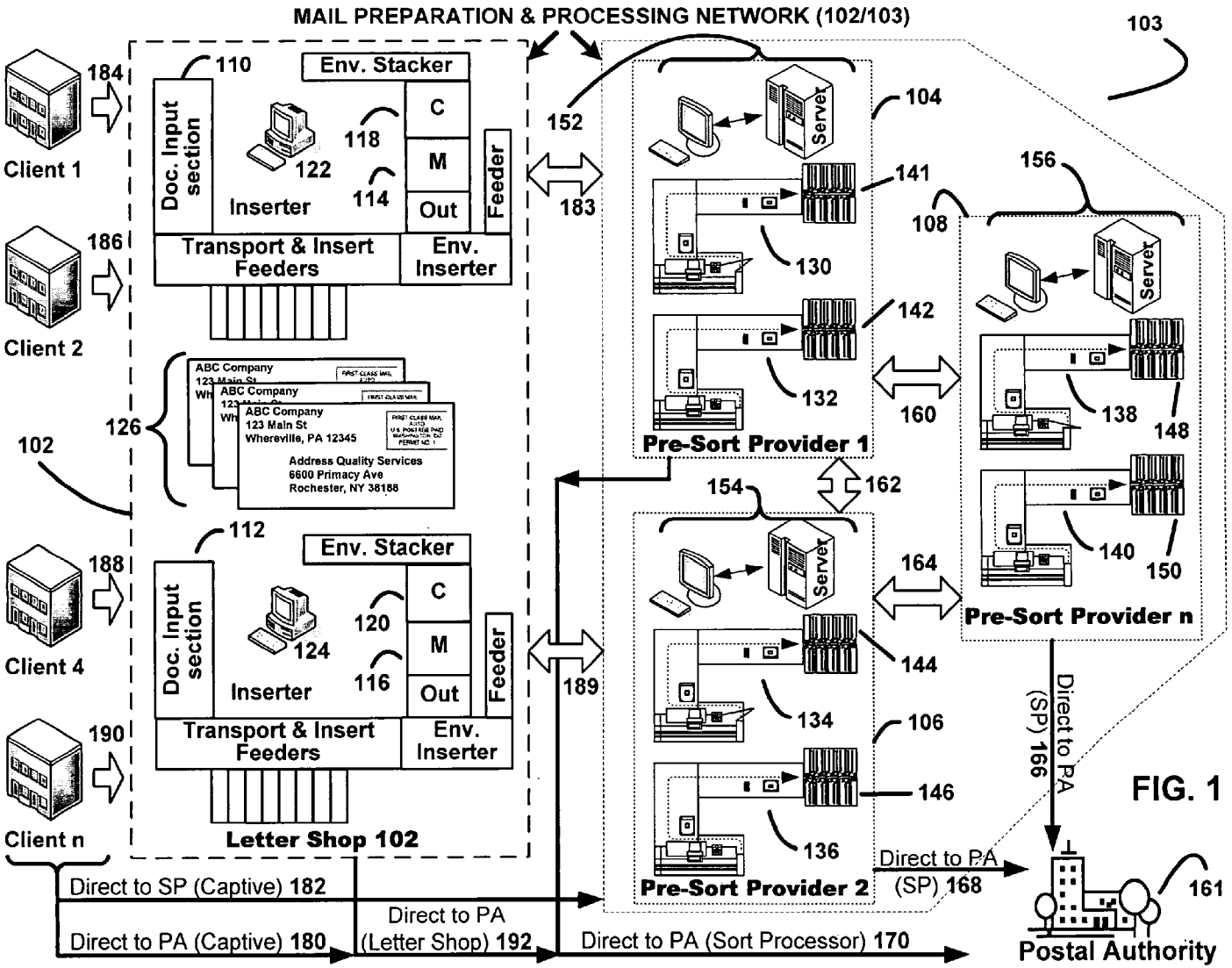
FIG. 1 depicts an exemplary mail processing network for enabling the distribution of mail processing tasks.

FIG. 1 depicts an exemplary mail preparation and processing network 102/103 for enabling the distribution of mail processing tasks across differing document processing devices and/or different document processing environments. The mail preparation and processing network may include one or more differing environments (e.g., inserter processing environment 102, sort processing environment 103), processes, people, devices, services (e.g., list processing service providers), data and other resources for receiving mail items as input from one or more owners or clients, and coordinating and distributing the processing required of said mail items, ultimately for submission of one or more of said mail items to a postal authority, private post, courier network or other mail item delivery channel. For the sake of clarity, it will be assumed that any reference to the mail preparation and processing network is interchangeable with either of an inserter processing environment 102 and/or a sort processing environment 103, both of which will be discussed in further detail in subsequent paragraphs. Furthermore, it will be understood by those skilled in the art that other peripheral network or data services, while not physically residing within an inserter or sort processing environment, may also be a vital aspect of said environments for enabling maximum work sharing discounts.

A mailing comprising a plurality of mail items bearing one or more address components or delivery point identifiers (in the form of address data and/or specified within an address block barcode) and destined ultimately for distribution to recipients via a postal authority 161 is owned by one or more Clients 1-*n*. By "owned," it is meant that the instructions and/or data indicating the plurality of recipients to which mail is to be distributed is at the discretion of the one or more Clients 1-*n*. As such, the owners make the original decision as to which recipients their mail items are to ultimately be directed (the mailing list), despite the fact that the data regarding the intended recipient may at times not correspond to postal authority rules (e.g., address data may require updates). With an ownership interest, Clients 1-*n* may act as a "captive mailer," whereby the client actively generates their own mailing for direct submission 180 to the postal authority 161; oftentimes employing postal authority certified software tools and data to ensure proper usage and application of addresses, postal authority codes (e.g., PLANET, POSTNET, Intelligent Mail Barcode), and other data required by the postal authority. Alternatively, Clients 1-*n* may outsource the mail generation and preparation tasks to a Letter Shop 102 or Sort Processing Service Provider 1-*n* of, both of which may comprise a mail preparation and processing network 102/103. Outsourcing of this nature corresponds to events (arrows) 182 or 183 and 189 respectively. As will be seen in further detail later on in the written description, whether Clients 1-*n* are captive or outsource their mailings, they are generally assigned some form of unique identification by a postal authority or other intended delivery channel for enabling a means of linking owners to their respective mailing. This identification must be expressly specified during submission of their mailings to a party within the mail preparation and processing network by said clients or in some cases dynamically assigned on behalf of the clients by a party within the mail preparation and processing network 102/103.

Within the mail preparation and processing network, an inserter processing environment such as Letter Shop 102 may employ one or more inserter devices 110 and 112 for enabling distributed mail processing as well as data exchange between the inserters 110 and 112, postage meters 114 and 116, camera devices 118 and 120, printers, mail preparation software tools as maintained by a control computer 122 and 124 and other equipment or devices for the purpose of generating mail items 126 displaying one or more delivery point identifiers. From the perspective of the United States Postal Service (USPS), delivery point identifiers are markings placed onto the mail item including but are not limited a 5-digit, 9-digit or 11-digit ZIP Code designation. Delivery point identifiers facilitate distribution of the mail item through the postal authority in combination with other address components as marked upon the mail item, including but not limited to the recipient's name, recipient's point of delivery street name, street number, suite or apartment number, P.O. Box, city and state. The Letter Shop 102, which may also include accumulators, folders, envelope feeding systems and other tools, may prepare mail items for direct distribution to the postal authority 192 without any additional sort processing. In such cases, the Letter Shop 102 employs pre-sort software and various data processing schemes for arranging inserter based production of the mail items in an order suitable for meeting postal regulations and garnering some postal work sharing discounts. In other instances, however, the Letter Shop 102 may direct prepared mail items to a Sort Processing Service Provider 104-108 (also known as a Pre-Sort Bureau), corresponding to events 183 and 189.

Sort processing environments 103 may comprise one or more independent Sort Processing Service Providers 104-108, and/or may include one or more sorter devices 130-140. Each sorter 130-140 is capable of processing a plurality of mail items at high speeds into one or more sort bins 141-150. Each sorter features a transport system along which mail items are moved from a magazine in-feed system to the sort bins 106 and 108—a collection of pockets intended for holding mail items. Along the transport system various additional processing devices operate upon mail items as they are guided along to the sort bins 141-150, including but not limited to: one or more printers for enabling the application of additional markings onto a mail item such as postal codes (e.g., barcodes conforming to postal authority 161 conventions), a postal code verification system for verifying postal code integrity and application (e.g., barcode verification and identification), reader systems 116 and 118 for detecting and interpreting delivery point identifiers residing on the mail item, and other devices.

The sort bins 140-150 are populated with mail items in accord with a sort scheme, instructions that dictate the behavior of the sorter device, the above described additional processing devices, and the sort bin to which a mail item is to be placed in response to the detection and/or interpretation of one or more delivery point identifiers. Generally, the sort scheme is a function of the delivery point identifiers placed on the mail item, postal authority mail grouping rules (also referred to commonly as a postal ZIP scheme), the resource constraints of the sorter such as the number of pockets available and other considerations. Hence, as different mail items indicate different delivery point identifiers corresponding to differing mail grouping rules, the way in which mail items are placed into bins will vary accordingly. Similarly, the behavior of the above mentioned additional processing devices operating along the transport path will vary accordingly.

Sort scheme data is generally maintained and executed by the sorter computers 152-156, be they standalone or server based. In a multi-device environments such as 102 and 103, respective control computers 122 and 124 of the Letter Shop 102 or s 152-156 of the Sort Processing Environment 103 may communicate with one another to facilitate data exchange and coordinate mail processing tasks. In the case of the Sort Processing Service Providers 1-*n*, the sorter computers 152-156 may facilitate subsequent pass processing between the multiple sorters in instances where additional processing of mail items is required to generate maximum postal authority discounts respective to a sort scheme. The additional processing is frequently referred to as subsequent pass or second pass processing. The sort computer will analyze the processed mail characteristics versus postal work share rules and generate a subsequent pass sort scheme to be executed by the sorter—identifying which bins in the sorter need to be staged for subsequent pass processing. In a multi sorter environment, or if processing is to be shared between sites, the required data needed for subsequent pass or validation is processed and shared through the sorter servers 152-156.

Moreover, the Sort Processing Service Providers 1-*n* may exchange data and mail in accord with a work sharing agreement, which details of and data required for fulfillment of said agreement potentially include, but is not limited to mail processing guidelines, delivery point identifier criteria, weight classification rules, billing details, etc. for enabling mail items to be coordinated between related or unrelated resources. In accord with such an agreement, respective providers may compensate for deficiencies in their own or other providers' determined mail quality or quantity of mail items displaying particular delivery point identifiers, such that one or the other participants in the work sharing agreement may increase their work sharing discounts. This exchange of data and/or physical mail items within the mail preparation and processing network is depicted by arrows 182, 183, 189 and 160-164, where some are bi-directional to indicate the cooperative nature between mail processing environments 102 and 103 or devices accordingly. Those skilled in the art will recognize that the mail preparation and processing network 102/103 is exemplary in nature only, and may indeed contemplate various arrangements for the facilitation of data and/or physical mail exchange including but not limited to exchange between sorters and inserters, Letter Shops and Sort Processing Environments, clients and any of the aforementioned, etc. Also, it will be recognized that the exchange of data required to enable maximum work sharing advantages may be between machines within a common mail processing facility of the mail preparation & processing network 102/103, machines at differing facilities or both. In other instances, subsequent processing may be performed by the same device as performed first pass processing. In either scenario, a "subsequent processing arrangement"—be it performed by the same or differing devices—is necessary to enable effective facilitation and processing of the mail to attain effective work sharing discounts.

For example purposes, and not by way of limitation, reference is made again to the sorter processing environment 103. In this example, the sorter computers 152-156 may also communicate directly with the postal authority 161, such as to fulfill data reporting requirements. Similarly, each individual Sort Processing Service Provider 1-*n* may distribute its physical mail items directly to the postal authority, such as in properly aggregated pallets of mail, the former and latter scenario depicted by events 166, 168 and 170. In the case of a subsequent processing arrangement, the mail may be submitted in accord with the arrangement, whether this is by an overriding Sort Processing Service Provider or individually by each participating provider. Regardless, each participating provider must still be able to validate and verify the presence or lack thereof of any mail items it receives from another participant or from the client. Absence of this verification may lead to improper postal authority documentation and reporting, which could further lead to fines and penalties befalling generally the party that submitted the mail to the postal authority, i.e., the owner or the party operating on behalf of said owner.

Mail item tracking through all phases of production is possible using postal authority data codes, referred to herein as postal codes. Essentially, each mail item has some form of mail owner identification—i.e., "license plate number"—that is registered with the postal authority by means of the data that is submitted at the time of mailing. The identification may vary in form. For example, one type of identification is the Mailer Identification (MID), while another type of identification is the Customer Registration Identification (CRID). The MID is applied for and assigned by the United States Postal Service currently as a 6 or 9 digit value. As will be described subsequently in greater detail, the MID may be combined with this unique number (6 or 9 digits) and other data that is generated at the discretion of the mail preparation operation to produce a unique identifier (license plate). This unique identifier will remain unique for a period specified by the postal authority (e.g., 45 days). The unique identifier may be encoded into a postal code, such as an Intelligent Mail Barcode (IMB) and can be read each time the mail item is read by a postal code (barcode) reader. As a result, the mail item can be uniquely identified at each step in processing, such as between mail processing environments operating in accord with a subsequent processing arrangement, as well as each time it is processed.

The CRID is generated to identify other organizations or processing environments that play a part in a mail item's preparation and processing, but does not itself qualify to receive a MID. This may be due to traditionally low mail volumes as processed by said mail processing environment, or simply due to the type of operation it performs, wherein the CRID is assigned via a web services transaction. An exemplary use of the CRID would be a data services provider, which while serving to maintain a properly composed address list on behalf of an owner, has no other involvement in the physical production of the mail. Like the MID, the CRID may be encoded within a postal authority barcode.

Skilled practitioners of the art will readily recognize that postal authorities have numerous uses for the tracking of mail items. For example if a mail item is determined as being prepared incorrectly, the postal authority may reference the MID of the party that submitted the mail based on the postal code applied to the mail item. However, as discussed later, the MID may not always be associated with the mail processing environment that submitted the mail item to the postal authority. Nevertheless, by using the unique identifier as detected via a postal code and referencing the required postal documentation (e.g., Mail.dat) submitted with the mailing, each mail processing environment that played a role in the production of the mail item can be identified. In effect, the various data that comprises the postal documentation acts as suitable metadata that enables enhanced tracking and point-of-accountability of mail items. All mail owner identification such as CRIDs and/or MIDs that were a party to mail production are in the metadata and referenced to the mail owner identifier. Another element of tracking is to ensure that incorrect addresses are eliminated from client address lists through the Address Correction Service (ACS) for move updates and address list processing. The CRID can be used to identify the data services provider responsible for the list processing effort.

Figure 2:
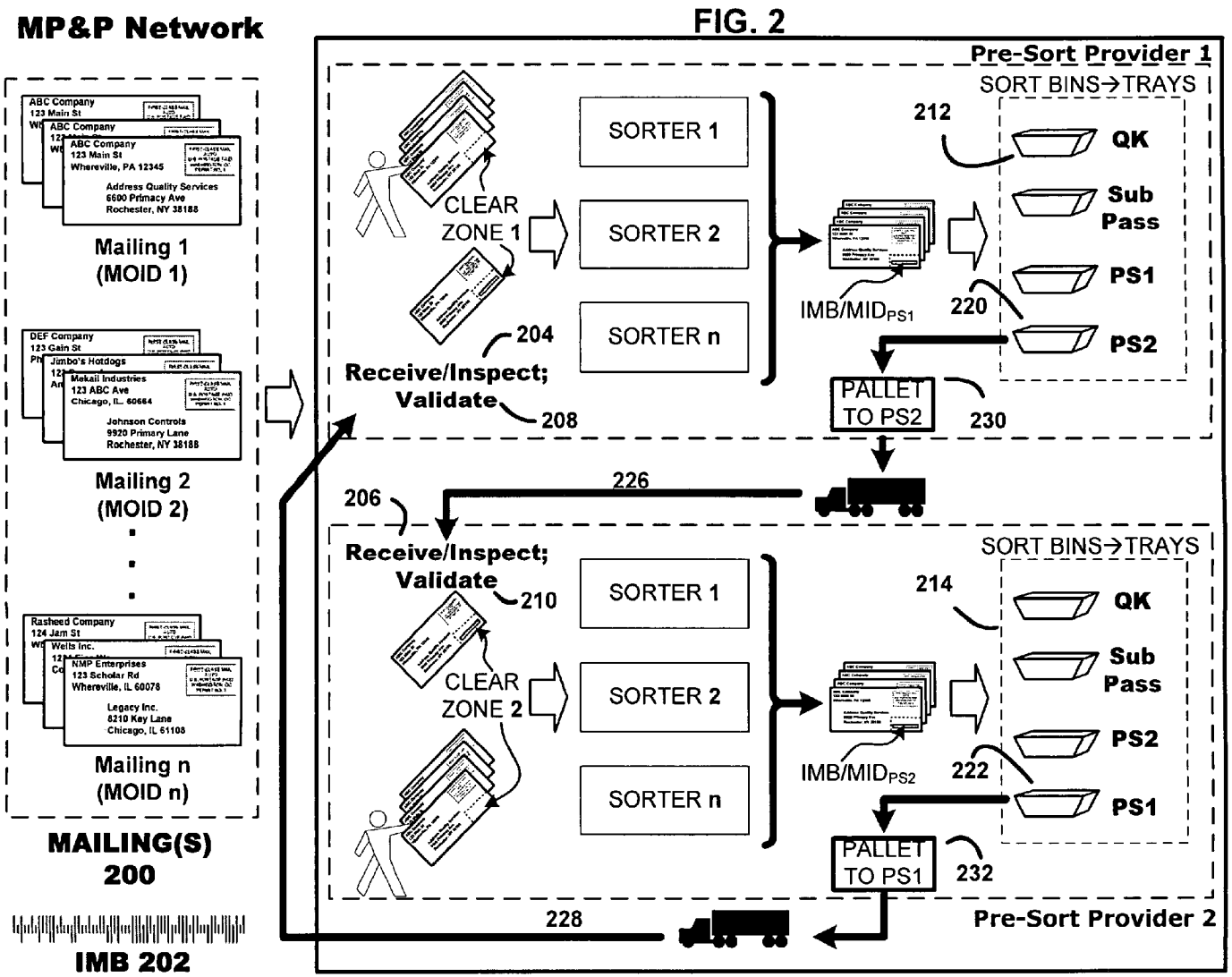
FIG. 2 depicts an exemplary validation process as performed between multiple sort processing environments.

Referring now to FIG. 2, an exemplary validation process as performed between different Sort Processing Service Providers 1 and 2 within the mail preparation and processing network is depicted. For the sake of this example, it is assumed that the Sort Processing Service Providers 1-2 collaborate in accord with a subsequent processing arrangement. Mailings 1-*n* are provided to the Sort Processing Service Providers, each mailing comprising a plurality of mail items displaying various delivery point identifiers. Moreover, each mail item comprising a particular mailing 1-*n* is associated with a mail owner identification value, labeled MOID 1-*n* respectively. The MOID 1-*n* is generally assigned by the postal authority or other mail item delivery channel as a means of identifying a specific owner or other party involved in the formulation, preparation and/or processing of each mail item comprising a mailing. In this way, the MOID ensures that a point-of-origination, accountability, or ownership of each mail item of the mailing may be maintained, and particularly in situations where the mailing is distributed according to a subsequent processing arrangement where multiple differing parties may be involved, as in FIG. 2. With this in mind, because each mail item comprising a particular mailing 1-*n* is associated with a unique MOID, the mailings may be distributed across the different Sort Processing Service Providers 1-2 without jeopardizing point-of-origin and accountability association. Furthermore, metadata respective each mail item may be maintained in connection with an assigned MOID to provide further means of tracking said mail item by the various parties.

Instances where the mailing(s) 200 are submitted by a Letter Shop versus a captive owner/mailer may be appropriately distinguished by the postal authority through proper use and acknowledgement of a MOID. For example, consider a Letter Shop that performs inserter processing and other mail preparation tasks for a plurality of different mail owners (e.g., Clients 1-*n*). In this case, a unique MOID must be assigned for each of the individual owners of the mail items; wherein the Letter Shop may too employ its own MOID accordingly. TABLE 1 below indicates some of the various types of MOIDs, along with their respective relational assignments and functional uses.

TABLE 1

| Mail Owner ID Types | |
|---|---|
| Mail Owner ID (MOID) Type | |
| | Mailer ID (MID) |
| Relational Assignment | Assigned by Postal Authority (PA) to owners (clients) via MID registration process. |
| Functional | A Mailer ID is a type of MOID assigned to owners |

TABLE 1-continued

| Mail Owner ID Types | |
|---|---|
| Mail Owner ID (MOID) Type | |
| Use | (clients) who register accordingly with the PA; typically corresponding to those with larger mail operations (e.g., captive mailers/owners), processing larger mail volumes. Mailer ID of registered owners (clients) may be encoded within an approved postal code with varying ranges of digits at the discretion of the PA-i.e., 6 or 9-digits for the Intelligent Mail Barcode for USPS. |
| | Customer Registration ID (CRID) |
| Relational Assignment | Assigned by PA in connection with postal authority electronic documentation-i.e., for USPS this corresponds to MAIL.DAT, WebServices data for the owner, etc. May also be assigned by PA in connection with the owner's postage payment agreement-i.e., for USPS this corresponds to owner's Mailing Permit, is indicated in Postage Statements, etc. |
| Functional Use | A CRID is a type of MOID typically assigned to owners or clients having smaller or no mail operations, processing smaller mail volumes. Also, may apply to clients that are involved in mail processing tasks that don't involve physical processing of the mail, such as a data services provider. |

Mail item identification data or mail tray identification data may generally include a MOID in conjunction with other necessary data—i.e., delivery point identifiers—for distinguishing mail items or trays containing mail items respectively for identification and sort processing purposes. Of course, those skilled in the art will recognize that various other types of MOIDs may be employed, including but not limited to a Mail Facility ID, a Business Entity ID, a Mail Preparer ID, a DUNS ID, a FAST ID, 2D barcode, etc., all of which serve the purpose of enabling a point-of-origination and accountability of a given mail item within a given mail processing context or environment. Still further, those skilled in the art will recognize that the various types of MOIDs may or may not be specified by way of an approved postal code, e.g., the USPS IMB (described for example purposes later). Of particular relevance, especially in a subsequent processing arrangement is the ability for the MOID to be associated despite the exchange of mail items that may occur throughout the Mail Preparation and Processing Network. Indeed, many of the above named or described types of MOIDs may be assigned interchangeably by the postal authority, and it is recognized that advancements in postal codes and assignment processes may vary over time without limiting the scope of the examples herein.

Sort processing begins with receipt, entry and loading of data related to all of the mailings and/or clients scheduled for required initial pass processing along with appropriate first pass sort schemes into the sort computers of Sorters 1-*n* for any given provider. Data entered or loaded may include, but is not limited to, client profile information such as the client's assigned MOID, mail type to be processed, mail volume to be processed, service request information, postage payment agreement data, subsequent processing arrangement billing information, etc. Load distribution data may also be entered at this time in instances where the mail volume is to be segregated amongst sorters for subsequent processing or concurrent processing purposes. Rather than manual entry of the above described data, it may also be exchanged electronically in advance of receipt of the physical mail items (e.g., advanced receipt of mail data or mailing lists), enabling advanced setup and preparation to commence. All the aforementioned tasks coincide with the receive/inspect step 204 and 206 of the figure. It will be seen in future paragraphs of the exemplary description that an additional and often related step of validating mail items 208 and 210 may also be performed. Once mail items are received and inspected, sorting operations can commence.

During sort processing, any address components and/or delivery point identifiers marked upon the mail items are read and interpreted by a reader device, such as to determine the corresponding 11-digit ZIP Code information. This information is useful for enabling a Sorter 1-*n* to place mail items into one or more sort bins 212 and 214 (and eventually to one or more mail trays) in accord with a sort scheme that itself accounts for postal authority requirements and other sort processing constraints. For example, one or more sort bins may be dedicated for maintaining items determined to be quick kills (labeled QK) or those requiring subsequent pass (labeled Sub Pass). Other sort bins may house mail items displaying delivery point identifiers favorable to another Sort Processing Service Provider in accord with a subsequent processing arrangement. This is depicted in FIG. 2 as sort bin/mail tray 220 of Sort Processing Service Provider 1 as being designated for accumulating mail items required for Sort Processing Service Provider 2. Similarly, sort bin/mail tray 222 of Sort Processing Service Provider 2 accumulates mail items corresponding to Sort Processing Service Provider 1. Once sort processing is complete, the mail trays may be advanced to the next sort processing device for subsequent pass processing, accumulated into pallets for direction to the postal authority, or accumulated into pallets for direction 226/228 to a corresponding Sort Processing Service Provider—i.e., pallet to Sort Processing Service Provider 1 230 versus pallet to Sort Processing Service Provider 2 232.

Initially the mail items received may or may not already have an approved postal code printed onto it. When the postal code in question is a barcode, such as the Intelligent Mail Barcode (IMB) 202, proper generation and application of the IMB within the context of the differing environments 102 and 103 of the mail preparation and processing network is critical. In particular, the IMB must be sufficiently associated with a corresponding MOID to enable a point-of-origination and accountability to be maintained for each mail item. Such dynamics are discussed with respect to FIG. 3. Suffice to say, those skilled in the art will recognize that the IMB 202 is only one type of postal code useable in connection with mail items displaying various delivery point identifiers through the Mail Preparation and Processing Network, and does not limit the scope and application of the techniques and concepts presented herein. Indeed, any type of postal code, be it barcode based, alpha-numeric, graphical or other may be employed within the context of the examples herein.

Figure 3:
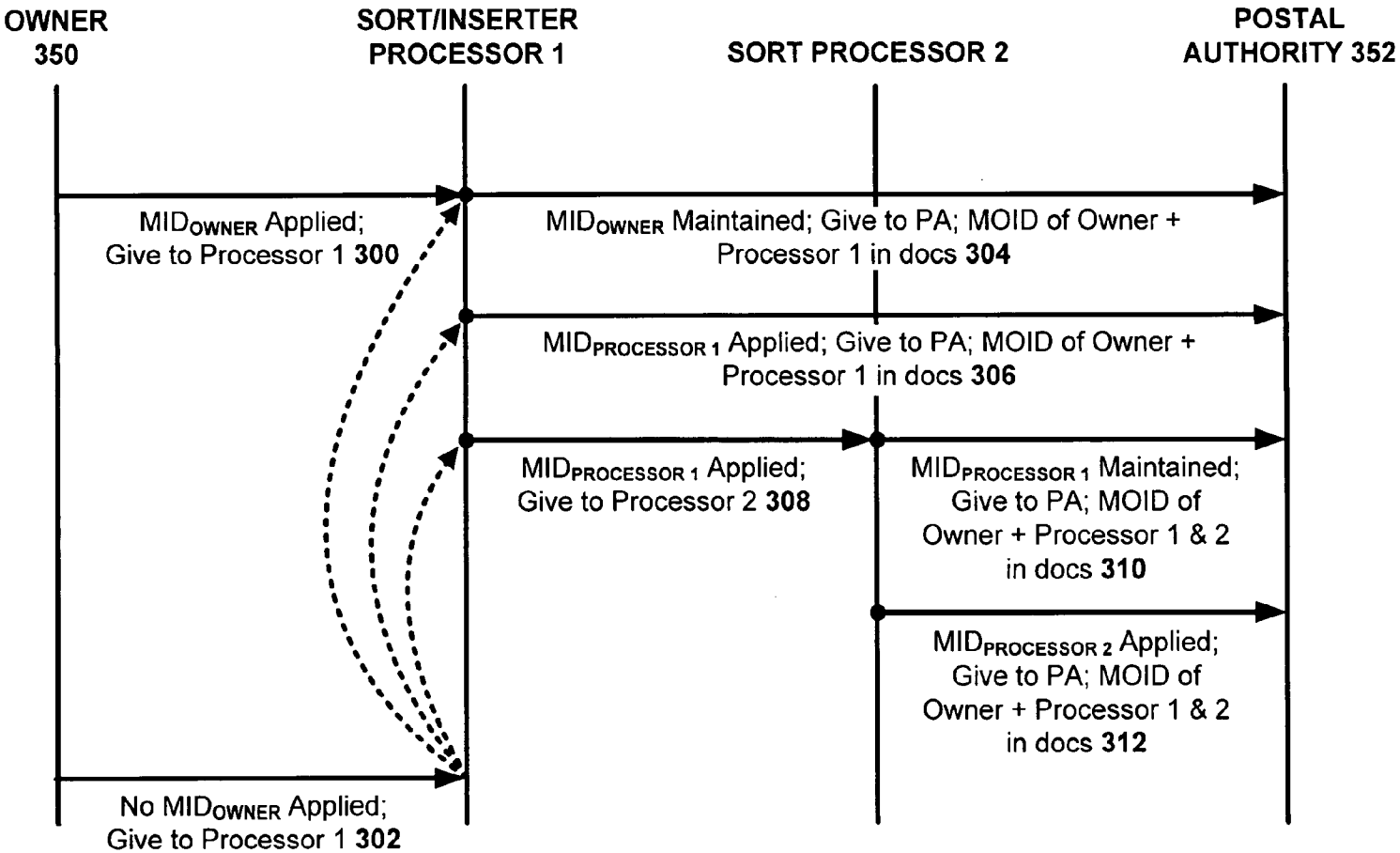
FIG. 3 is flowchart depicting the process by which a first sorter device may engage in subsequent pass processing with a second sorter device.

Generally, the various devices, resources and environments of a Mail Preparation and Processing Network may include a sort processing environment, an inserter processing environment or both. This is depicted in FIG. 3 as Sort/Inserter Processor 1, which corresponds to sort processing environment 103 and/or inserter processing environment 102 of FIG. 1. Sort Processor 2 depicts a subsequent sort processing environment (or device) that may process mail items after Sort/Inserter Processor 1. An owner 350, such as one acting in the capacity of a captive shop, may submit their mail items in various forms for processing, including: in the form of a print file specifying the various address components, delivery point identifiers and address block barcodes as required, wherein at least the MOID of said owner is indicated; in the form of a print file specifying the various address components, delivery point identifiers and MOID as assigned to the owner. In the latter scenario, no address block barcode need necessarily be specified within the print file, as the owner may expect their MOID in the form of a MID (or CRID) to be encoded within an IMB. Hence, the owner may submit their mail items with their own IMB applied (event 300), or without (event 302). When applied (event 300), the MOID may be encoded within the IMB as a six or nine-digit data field within the IMB 202 known as a mailer identifier (MID).

As alluded to before, the MOID is generally assigned by the postal authority 352 based on the annual mail volume of the registrant (e.g., the owner 350), registration status, and other considerations. Another data field of the IMB 202 may include a unique number, which is assigned at the discretion of the entity applying the IMB to the mail item (e.g., owner 350 in this case). The unique number of the IMB must be certifiably unique for a period of time, say 45 days. The unique number enables further means of mail item personalization for tracking purposes, wherein the combination of the mailer ID and the unique number constitute a unique identifier. Yet another data field of the IMB 202 may be a delivery point address code that specifies the delivery point identifier data (e.g., 5-digit ZIP, 11-digit ZIP) of the mail item. While various other details regarding the IMB may be emphasized, it is sufficient to say in the case of the owner applying an approved postal code to its mail items (event 300) in advance, the IMB is associated with the MOID of the owner.

The Sorter/Inserter Processor 1 can process mail items received with a specified or assigned MOID of an owner in various ways. For event 304, the MID of the owner 350 can be maintained during processing of such mail items by the receiving Sort/Inserter Processor 1. In this scenario, assuming no further processing of the mail items is required by Sort Processor 2 in accord with a work sharing agreement or due to subsequent pass processing, said mail items may be advanced to the postal authority 352 as is. Of course, any required postal documentation would specify the MOID of the Owner 350 in the form of a MID and Sort/Inserter Processor 1. The postal documentation is created at least in part based on metadata maintained respective to the mail items—i.e., by the respective control computer—throughout their processing in connection with the applied MOID.

For event 306 the IMB of Sorter/Inserter Processor 1 can be applied during processing, such as to a clear zone area of the mail items, effectively taking process priority over the MID as applied or specified by the owner. In this scenario, assuming no further processing of the mail item is required by Sort Processor 2 in accord with a subsequent processing arrangement, said mail items may be advanced to the postal authority 352 with the newly applied MID as encoded within an IMB. Of course, any required postal documentation would specify the MOID of the Sort/Inserter Processor 1, such as in the form of an MID and Owner 350, such as in the form of a CRID. The postal documentation is created at least in part based on metadata maintained respective to the mail items—i.e., by the respective control computer—throughout their processing in connection with the applied MOID For event 308 the IMB of Sorter/Inserter Processor 1 can be applied during processing, such as to a clear zone area of the mail items, effectively taking priority over the MID as applied or specified by the owner. When further processing of the mail item is required by Sort Processor 2 in accord with a subsequent processing arrangement (e.g., such as events 226/228 of FIG. 2), said mail items may be advanced accordingly to Sort Processor 2. Sort Processor 2 may then apply its own MOID in the form of an MID (event 312) or maintain that applied or specified by Sort/Inserter Processor 1 (event 310). In either events 310 and 312, any required postal documentation would specify the MOID of Sort Processor 2 such as in the form of an MID, the Owner 350 and Sort/Inserter Processor 1. Postal documentation is created at least in part based on metadata maintained respective to the mail items—i.e., by the respective control computer—throughout their processing in connection with the applied MOID.

When the owner 350 submits mail items that possess no IMB (event 302), receiving Sort/Inserter Processor 1 must apply a postal code to the mail items (e.g., to a clear zone area as designated by the postal authority). In this case, this requires Sort/Inserter Processor 1 to perform events 304, 306 or 308 accordingly. Of course, postal documentation must appropriately specify the MOIDs associated with a given mail item as processed by a given Sort Processor/Inserter Processor or owner 350. Those skilled in the art will recognize that the postal documentation may vary. Suitable item-level and postal sort group level data disclosed within the documentation, whether the documentation is generated in hardcopy or softcopy form, may include but is not limited to: mailer ID representative of the MOID assigned to the owner 350, mailer ID representative of the MOID assigned to the Sort/Inserter Processor 1 or 2, unique number (alternatively, an ACS match back code) as assigned to a postal code, 11 digit ZIP data for a given item or MOID, item count data for a given MOID, mail tray identifier data specifying items corresponding to a particular MOID, a sort bin number to which the mail item was directed, sort scheme ZIP designation as defined by the sort scheme for that particular sort bin, other customer profile data (e.g., CRIDs), sorter profile data, etc. Data of this nature may be maintained during processing on a per-item basis as metadata—i.e., by the respective control computer.

Figure 4:
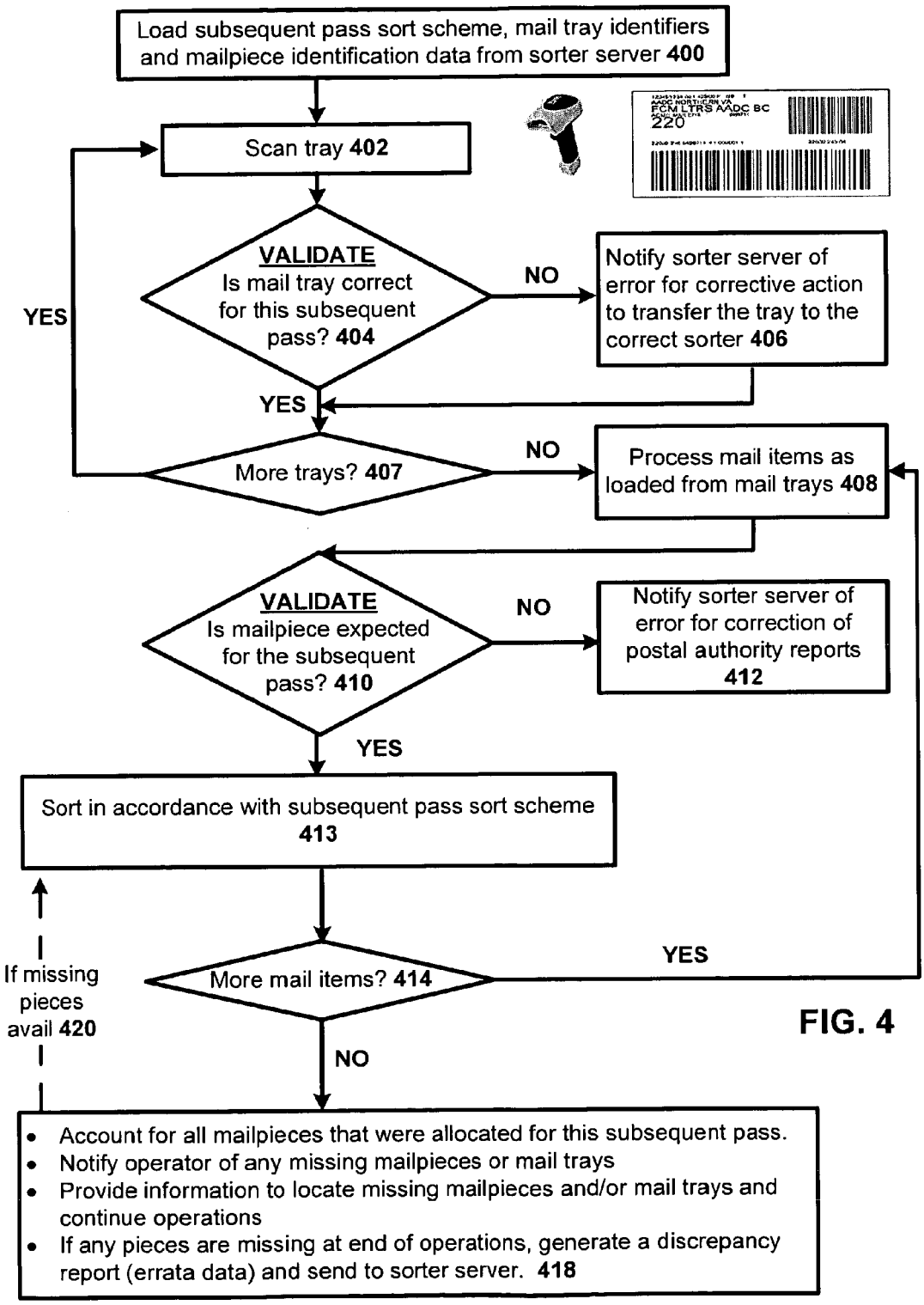
FIGS. 4-5 are flowcharts depicting the process by which a plurality of mail items received from a first document processing device may be tracked and validated for processing by a second document processing device.
Figure 5:
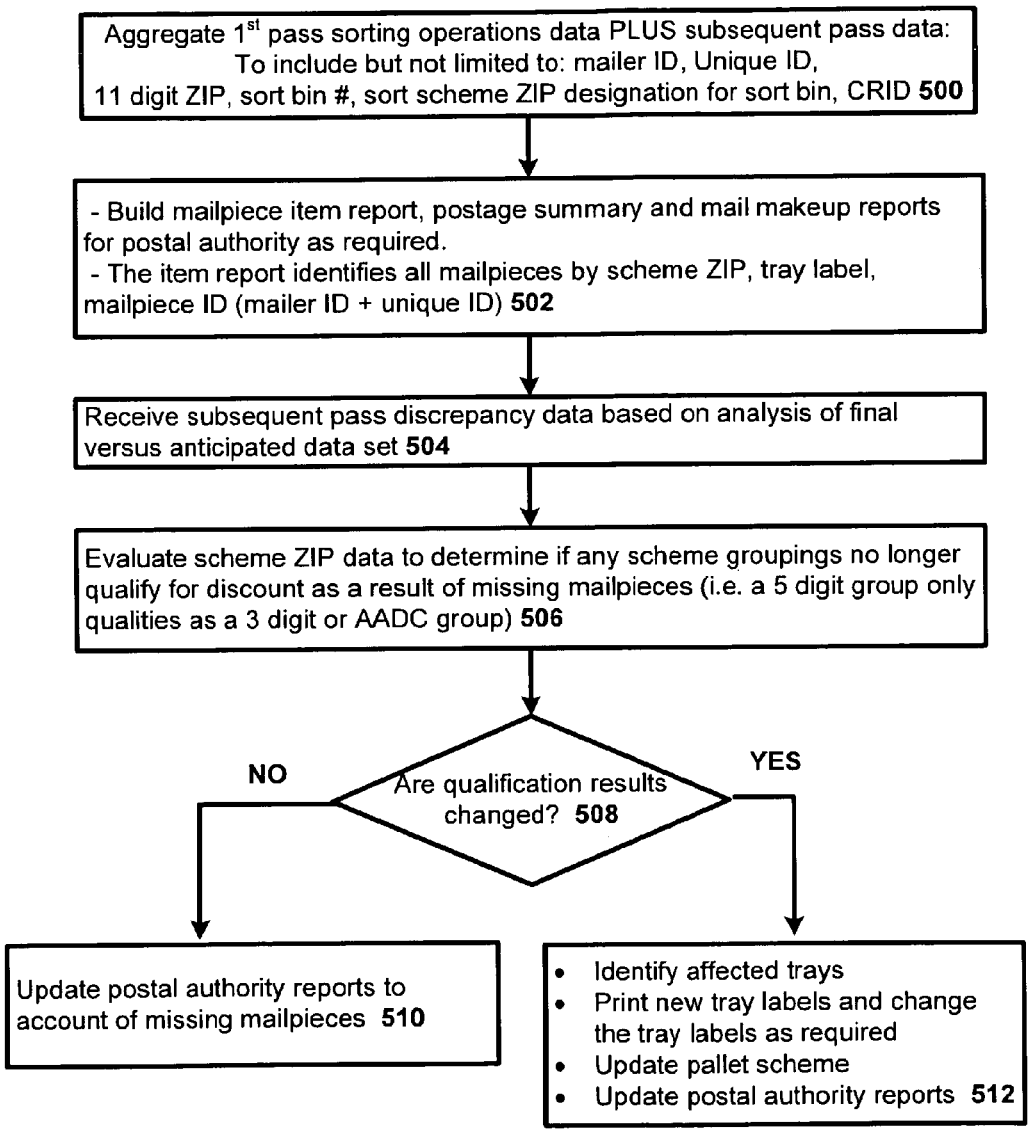

FIGS. 4-5 are flowcharts depicting the process by which a plurality of mail items received from a first sorter and/or inserter processing environment may be validated for processing by a second sorter and/or inserter processing environment. The foregoing validation process was alluded to with respect FIG. 3, which depicts a first Sort Processing Service Provider 1 and second Sort Processing Service Provider 2 operating in accord with a subsequent processing arrangement. In this example, the pallets 230 and 232 scheduled for delivery to respective processing environments—corresponding to event 226/228—contain various mail items including some set aside expressly by the providing Sort Processing Service Provider for processing by the receiving Sort Processing Service Provider. In the context of a work sharing agreement or subsequent processing arrangement between resources, devices and environments within a Mail Preparation and Processing Network, the provider sends mail items to another, while the receiver accepts the mail items of another. The roles of provider or receiver may be interchangeable, such as in the case of FIG. 3.

The receiving Sort Processing Service Provider (or device) first calculates and/or loads into its sorter computer any subsequent pass sort scheme data required to process the incoming mail items, some of which may include mail items (event 400) allocated by a provider. Hence, the parties involved in the work sharing agreement or subsequent processing arrangement are privy to data indicative of what mail items to expect from one another. Also, the associated mail tray identifiers and mailer ID data respective to said items may be loaded in advance. Such data may be communicated in advance of delivery of the mail items to the receiving Sort Processing Service Provider or device via shared or network based communication between respective sorter computers. Once received, each mail tray is scanned (event 402) to detect a postal authority code (e.g, Intelligent Mail Barcode based tray tag identifier), and a determination is made as to whether or not the mail tray is valid for subsequent pass processing to be performed in accord with the subsequent processing arrangement (event 404). When determined invalid, the sorter server is notified to enable corrective action to be pursued—i.e., transfer of the invalid mail tray to the correct sorter, delivery of the mail tray to the correct receiving Sort Processing Service Provider, etc. (event 406). When determined valid, events 402-407 are repeated for any additional mail trays until all have been scanned and appropriately validated.

Alternately, each mail tray can be scanned when the content of the tray is ready to be loaded onto the sorter. Consequently, this may result in not knowing that mail trays are missing until all the subsequent pass mail has been processed through the sorter. With this in mind, another alternative is to scan all mail trays that belong to a specific sort group before processing that group. Those skilled in the art may employ varying techniques accordingly.

Sort processing further includes validation of each mail item loaded from the mail trays as they are processed by the receiver. Verification may include processing of mail items by a reader system for interpreting its various address components or delivery point identifiers, or processing by a postal code verification system; to determine whether or not the mail item in question was expected for subsequent pass processing (events 408-410). When a mail item is determined to be invalid, the sorter server of the receiver is notified to enable corrective action to be pursued—i.e., adaptation of postal authority documentation of data, direction of mail item to a reject sort bin (event 412). When determined valid, the mail item is sorted in accord with the subsequent pass sort scheme (event 413), and steps 408-414 are repeated for any additional mail items until all have been processed.

Once complete, various maintenance and accountability functions (event 418) may include, but is not limited to:

Accounting for/recording all mail items that were allocated for the subsequent pass processing as performed by the receiver.

Notifying the operator of the receiving sorter device of any missing mail items or mail trays. Such discrepancy data, as determined during the validation process, would be based on expected provider mail item data in the context of a subsequent processing arrangement between the receiver and the provider.

Providing information to locate missing mail items or mail trays. Said items or trays can be processed according to the subsequent pass scheme 413 after being located, as indicated by dashed line 420.

It should be noted that the operator may be the person operating the machine or any other authorized person with electronic or paper access to the data and able to take action as required. Data of this nature may be communicated to and by the sorter server of the receiving sort processing device.

Having processed and accounted for the subsequent pass mail items, the data as stored to the sorter computer 110 may be leveraged to generate postal authority required documentation (event 502). This may include collecting metadata from the sorter server related to first pass processing of a mailing, including but not limited to mailer ID data, 11-digit ZIP data, MOID data, etc. (event 500). Essentially, the data as collected respective to first pass would be that collected during subsequent pass, so that the aggregate of first and second data sets results in a complete data set for generation of postal documentation. The postal authority documentation may be of various types, including a mail makeup report and mail item report. In particular, the mail item report may indicate the one or more associated unique identifiers (mailer ID+unique number 210) that correspond to a particular MOID. The item report may also identify an associated tray label and mail item identifier. The mail makeup report may indicate the sort scheme and sort bin designation data that is relevant to the receiver and/or owner. Of particular importance to those skilled in the art is the fact that all of this data may be maintained by the one or more respective control computers within the mail preparation and processing network 102/103 for subsequent retrieval and review.

As a final step in the process, an evaluation may be performed to determine the affect of any invalid mail items or trays against anticipated work sharing discounts (event 506). Anticipated work sharing discounts may include data analysis or calculations performed prior to subsequent pass processing for the purpose of justifying exchange of mail items across processing providers and/or devices. This may be determined through analysis of the complete valid data set as aggregated/received versus that which was anticipated (event 504). For example, if a receiving Sort Processing Service Provider was to receive a quantity of mail items having certain delivery point identifiers or postal codes from a providing Sort Processing Service Provider in order to quality for work sharing discounts at a higher level, variations in the quality or quantity of the provided mail items could hamper this objective. In instances where there are discrepancies, but none that affect the postal qualifications results, the postal authority documentation needs to be updated to account for such discrepancies (event 510). When the qualification results have changed due to discrepancies, the postal authority documentation must be updated accordingly (event 512), which may include performance or initiation of the following processing tasks by the respective control computer:

Identifying and/or indicating affected mail trays;

Printing and subsequently applying new tray labels to the identified affected mail trays as required;

Updating pallet scheme data responsive to the determined discrepancies;

Updating postal authority reports responsive to the determined discrepancies; and Initiating an additional subsequent pass run as required to maintain compliance with PA pre-sort rules.

In some instances, the discrepancy data may also show additional unexpected mail that may need to be processed. These extra mail items or mail trays can be processed in accordance with the current sort scheme and documentation updated accordingly. Extra mail may result in the need to run a subsequent pass and to submit some of the mail as residual mail at full postage if no qualifying trays can be prepared.

The above described tasks may be performed automatically in response to a perceived change or discrepancy, or at the discretion of an operator. Furthermore, in the context of a subsequent processing arrangement, the participating processing environments or devices may readily exchange discrepancy results dynamically. Such exchange of data may enable seamless execution of the above discrepancy result responses across environments or devices. Furthermore, the receiving and providing environments and devices could more readily coordinate and arrange the data necessary for the generation of postal authority documentation.

With regards to data, skilled practitioners will recognize that the above described mail item processing tasks may result in the generation of various types of data, some of which are expressly required to be maintained for postal authority documentation reporting purposes. However, other types of data may be maintained as metadata throughout processing including but not limited to, machine data (e.g., sorter or inserter profile data), client profile data, subsequent processing arrangement data respective to the participating mail processing environments, billing information, MOID data, scheduling data, job requirements data, weight class data, etc. Indeed, any data that is useful for enabling tracking of a mail item, particularly in connection with a MOID of various types, may be maintained as metadata. Such metadata may be shared seamlessly between mail processing environments and/or devices within a subsequent processing arrangement, to fulfill subsequent pass processing, to enable seamless communication with a postal authority, etc.

Figure 6:
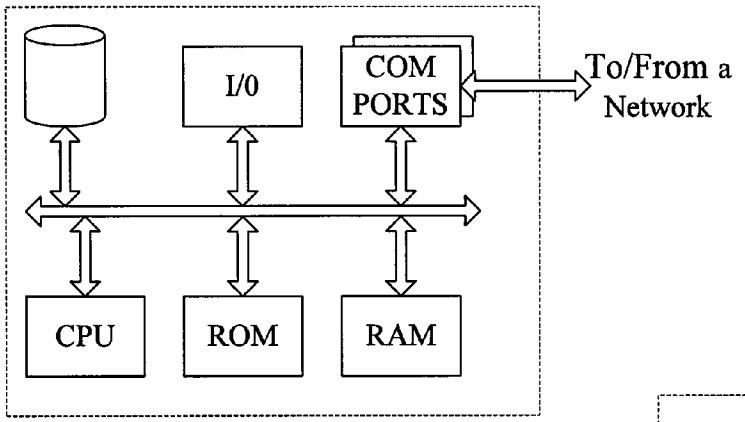
FIG. 6 illustrates a network or host computer platform, as may typically be used to implement a server.
Figure 7:
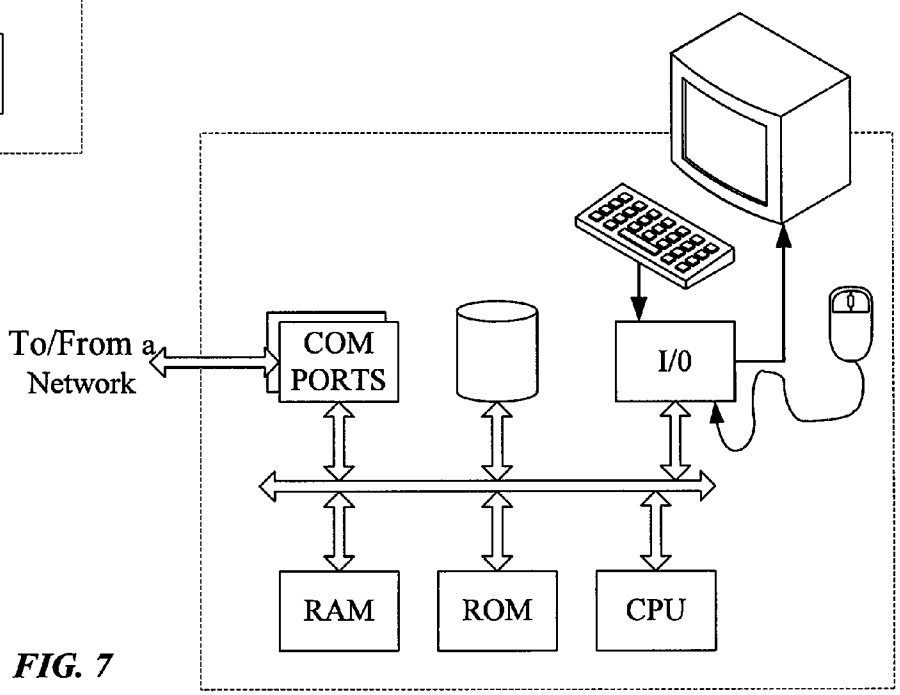
FIG. 7 depicts a computer with user interface elements.

FIGS. 6 and 7 provide functional block diagram illustrations of general purpose computer hardware platforms. FIG. 6 illustrates a network or host computer platform, as may typically be used to implement a server. FIG. 7 depicts a computer with user interface elements, as may be used to implement a personal computer or other type of work station or terminal device, although the computer of FIG. 7 may also act as a server if appropriately programmed. It is believed that those skilled in the art are familiar with the structure, programming and general operation of such computer equipment and, as a result, the drawings should be self-explanatory.

For example, control computers 122, 124 and 152-156 may be a PC based implementation of a central control processing system like that of FIG. 7, or may be implemented on a platform configured as a central or host computer or server like that of FIG. 6. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software as well as data, such as sort scheme instructions and image data. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer in a document factory may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for processing document data as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model—i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as an "article of manufacture" may take the form of code or executable instructions for causing a computer or other programmable equipment to perform the relevant data processing steps regarding document printing and associated imaging and print quality verification, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Nonvolatile storage media include, for example, optical or magnetic disks, such as any of the storage devices in any computer (s) or the like, such as may be used to implement the sorting control and attendant mail item tracking based on unique mail item identifier. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A system for validating mail items, the system comprising:

one or more mail processing devices for performing subsequent pass processing of a plurality of mail items in accordance with a sort scheme;

one or more processors associated with the one or more mail processing devices for:

receiving mail item identification data associated with the plurality of mail items based on previous sort processing performed at one or more mail processing environments, the mail identification data comprising mail owner identification, registered with a postal authority, for each of the plurality of mail items for uniquely associating a mailer to each mail item; and reader associated with the one or more mail processing devices for reading the mail item identification data for each of the plurality of mail items during the subsequent pass processing, wherein the one or more processors is configured for: validating the received mail item identification data against the read mail item identification; and generating discrepancy data based on the received mail item identification data and the read mail item identification.

2. The system of claim 1, wherein the discrepancy data is generated on a user interface accessible by an operator of the one or more mail processing devices to indicate any mail items determined by the one or more processors as not valid.

3. The system of claim 2, wherein the discrepancy data further includes information to locate missing mail items.

4. The system of claim 1, wherein the discrepancy data is directed to a server computer communicable with the one or more mail processing devices.

5. The system of claim 1, wherein the reader is a barcode verification device.

6. The system of claim 1, wherein the unique identification mail identification data is a mailer ID (MID) included in a barcode printed on each of the mail items.

7. The system of claim 1 wherein the one or more mail processing devices are sort processors operating in accord with a subsequent processing arrangement.

8. A system for validating mail trays comprising:

one or more mail processing devices for performing subsequent pass processing of a plurality of mail trays containing a plurality of mail items in accordance with a sort scheme;

one or more processors associated with the one or more mail processing devices for:

receiving mail tray identification data associated with the plurality of mail trays based on previous sort processing performed at one or more mail processing environments, the mail tray identification data comprising mail owner identification, registered with a postal authority, for each of the plurality of mail trays uniquely associating a mailer to each mail tray; and a reader associated with the one or more mail processing devices for reading the mail tray identification data for each of the plurality of mail trays during the subsequent pass processing, wherein the one or more processors is configured to: validate the received mail tray identification data against the read mail tray identification; and generate discrepancy data based on the received mail tray identification data and the read mail tray identification, the discrepancy data identifying any missing or unexpected tray and its corresponding mail tray owner.

9. The system of claim 8, wherein the discrepancy data is directed to an operator of the one or more mail processing devices and a server computer communicable with the one or more mail processing devices.

10. The system of claim 8, wherein the discrepancy data indicates a corrective action to be performed responsive to any of the mail trays not matching the mail tray identification data.

11. The system of claim 8, wherein the reader includes a barcode verification device.

12. The system of claim 8, wherein the mail tray identification data is a mailer ID (MID) included in a barcode printed on each of the mail items.

13. The system of claim 11, wherein the processor further generates notification of any of the mail trays matching data in the record and enables processing by the one or more mail processing devices of any of the mail trays matching data in the record.

* * * * *